United States Patent [19]

Sato

[11] 4,170,938

[45] Oct. 16, 1979

[54] PRINTING HEAD FOR LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 842,396

[22] Filed: Oct. 17, 1977

Related U.S. Application Data

[63] Continuation of Ser. No. 669,816, Mar. 24, 1976, abandoned.

[30] Foreign Application Priority Data

Mar. 24, 1975 [JP] Japan ..... 50/034522
Jun. 25, 1975 [JP] Japan ..... 50/078610

[51] Int. Cl.[2] ..... B41J 1/20
[52] U.S. Cl. ..... 101/111; 101/105
[58] Field of Search ..... 101/111, 105

[56] References Cited

U.S. PATENT DOCUMENTS

| | | | |
|---|---|---|---|
| 1,346,912 | 7/1920 | Pitman | 101/111 |
| 1,724,264 | 8/1929 | Anston | 101/111 |
| 2,832,284 | 4/1958 | Farlens | 101/111 |
| 3,417,689 | 12/1968 | Brethen | 101/105 X |
| 3,793,951 | 2/1974 | Denley | 101/111 |
| 3,796,152 | 3/1974 | Finke et al. | 101/111 |
| 3,968,745 | 7/1976 | Hamisch | 101/111 |

*Primary Examiner*—Edward M. Coven

*Attorney, Agent, or Firm*—Ostrolenk, Faber, Gerb & Soffen

[57] ABSTRACT

A multi-line printing head for being mounted on a portable label printing machine, or the like: The printing head comprises printing devices and a housing for detachably supporting the printing devices; each printing device comprises: a pair of elongated frames; a plurality of large-diameter rotation wheels pivotally mounted to the upper portions of the frames and carrying stamp belts; an H-shaped member pivotally secured to the lower portions of the frames and being pivotable relative to the frames; the H-shaped member carrying a plurality of small-diameter rotation pieces; stamp belts supported by the rotation wheels and by the rotation pieces; on the opposed inside surfaces of side walls of the housing are formed printing device support means; in one embodiment, those support means comprise vertically extending inwardly projecting ridges which vertically and closely support the H-shaped members of the printing devices; in another embodiment, those support means comprise closely spaced vertically oriented grooves and each printing device H-shaped member supports a ridged fitting plate engageable with one of the grooves; in the latter embodiment, the housing comprises a fixed frame and a movable frame, with the latter supporting the printing devices; in the printing head, the spaces between lines are easily and accurately adjusted.

25 Claims, 13 Drawing Figures

>401628357
Γ1234567890
>$92.70

PRINTING HEAD FOR LABEL PRINTING MACHINE

This is a continuation of application Ser. No. 669,816, filed Mar. 24, 1976, now abandoned.

BACKGROUND OF THE INVENTION

This invention relates to an improved printing head capable of being mounted on a portable label printing machine, or the like. More particularly, the invention relates to a printing head which is provided with a plurality of printing devices. The printing head is used for simultaneously printing multi-line indicia such as price, size, production date and/or administrative numbers on labels or price tags which are applied or attached to desired articles such as commodities.

The printing head herein is of the belt type which carries endless stamp belts having on their outer surfaces several type elements for printing indicia, such as numerals, marks and symbols. This type of printing head for printing plural line indicia on labels includes printing devices for printing prices, dates, etc. Each such printing device generally comprises a plurality of large-diameter rotation wheels, each for selectively driving a respective stamp belt, and a plurality of small-diameter rotation pieces, each for supporting the respective stamp belt in the print region. Such printing devices are integrally mounted on a housing to form a plural line printing head.

In this type of printing head, the widths of the upper end large diameter rotation wheels, when printing devices are arrayed next to each other in a printing head define the minimum distance that can be placed between the type elements of stamp belts on both of the printing devices in the printing heads. Thus, the distance between two lines of type elements cannot be reduced. In practice, therefore, only indicia with large spacing between adjacent print lines are printed.

In certain situations, it is also desirable to set precisely controlled spacing between adjacent lines of print. But, known printing heads have preset interline spacing and do not permit interline spacing variation.

Also, it is desirable to control precisely where indicia will be printed along a label. But, known printing heads only permit printing at preset and quite difficult to vary locations on the label.

SUMMARY OF THE INVENTION

The primary object of the present invention is to provide a printing head of the type described in which multi-line indicia printing leaving smaller spaced between adjacent lines can be attained, particularly while using printing devices which have large diameter rotation wheels and small diameter rotation pieces.

Another object of the present invention is to provide improved printing devices which are detachably mounted on the printing head housing that carries them.

A further object of the invention is to provide an improved multi-line printing head which is able to print a plurality of lines of indicia wherein desired spaces are provided between the printed lines.

Another object of the present invention is to provide a printing head in which the spaces between lines of types can be adjusted easily and accurately, even down to tolerances on the order of about 1 mm.

A further object of the present invention is to provide a printing head in which the printing position of the indicia relative to or along the labels can be adjusted.

To realize the above objects, the printing head of the present invention is comprised of a plurality of independent printing devices and a housing for detachably supporting the printing devices. Each printing device comprises: a pair of elongated frames disposed in opposed relationship and leaving a certain space therebetween; a plurality of large diameter rotation wheels pivotally secured between the upper portions of the frames; the large rotation wheels each support a respective belt; an H-shaped member which is pivotally secured to the lower portions of the frames; the H-shaped member supports a plurality of small diameter rotation pieces that support the stamp belts in the print region; the H-shaped member is relatively pivotable with respect to the frame, which enables the printing device elongated frame and the large diameter wheels supported by that frame to be tilted out of the way of the neighboring printing devices and enables the printing devices to be placed closer to each other in the printing head.

The housing for supporting the printing devices has a pair of opposed side walls disposed in opposed relationship so as to provide a predetermined space therebetween in which the printing devices are placed; the housing detachably supports the printing devices.

In one embodiment, a plurality of inwardly projecting vertically extending ridges are formed at the same regular intervals on each inner side of the side walls of the housing. The ridges are spaced to form pockets into which the side plates of the H-shaped members can be placed. The ridges support the H-shaped members of the printing devices vertically and close together.

In another embodiment, there is a pair of fitting plates, each having either at least one guide ridge or at least one groove on its outside and each being attached outside a respective one of the side plates. In this embodiment, there is the complementary one of the engaging grooves and guide ridges on the inside walls of the housing frame to receive the guide ridge or groove that is formed outside the fitting plates of the printing device. The spacing of the grooves or ridges on the inside walls of the housing frame may be any distance, even quite small, whereby by selection of particular grooves or ridges for use, quite close control over printed indicia spacing is made possible.

In either embodiment, the printing head housing that receives the printing devices may be a simple unadjustable frame. However, in any embodiment, but particularly the second described one, the printing head housing comprises a fixed frame comprises of a pair of side plates, a front plate and a rear plate which are integrally joined, and a movable frame placed inside the fixed frame and comprised of a pair of spaced apart, opposed inside walls, each of which is provided with a plurality of vertical, fitting plate ridge (or groove) engaging grooves (or ridges) formed close together and at regular intervals. The movable frame is longitudinally slidable parallel to its inside walls in the fixed frame. A fixing member fixes the printing devices to the housing with desired spacing between the printing portions of the printing devices. Frame moving means move the movable frame longitudinally with respect to the fixed frame.

BRIEF DESCRIPTION OF THE DRAWINGS

The foregoing and other objects and features of the present invention will become apparent from the following description taken in connection with the accompanying drawings, in which.

DETAILED DESCRIPTION OF PREFERRED EMBODIMENTS

In FIGS. 1-6 of the accompanying drawings, a first embodiment of the present invention is shown.

Figure 1:
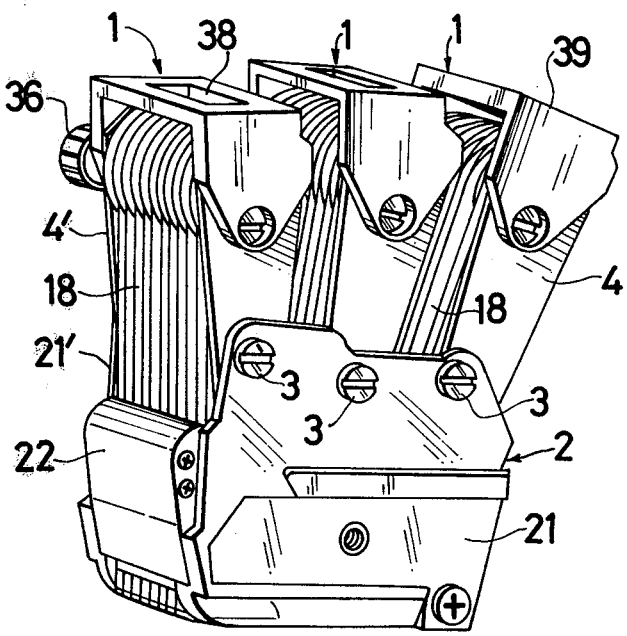
FIG. 1 is a perspective view of a first embodiment of the printing head of the present invention.
Figure 2:
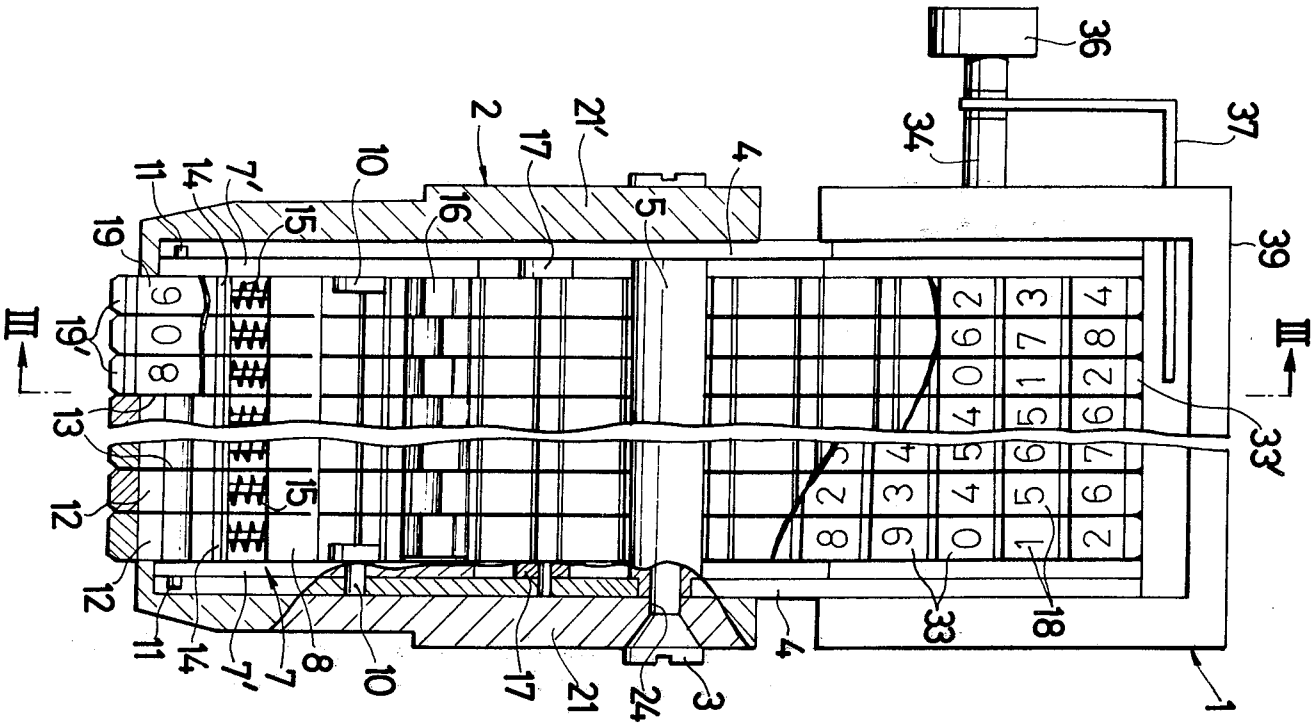
FIG. 2 is a cross-sectional, partly cut away, front elevational view of the printing head shown in FIG. 1.
Figure 3:
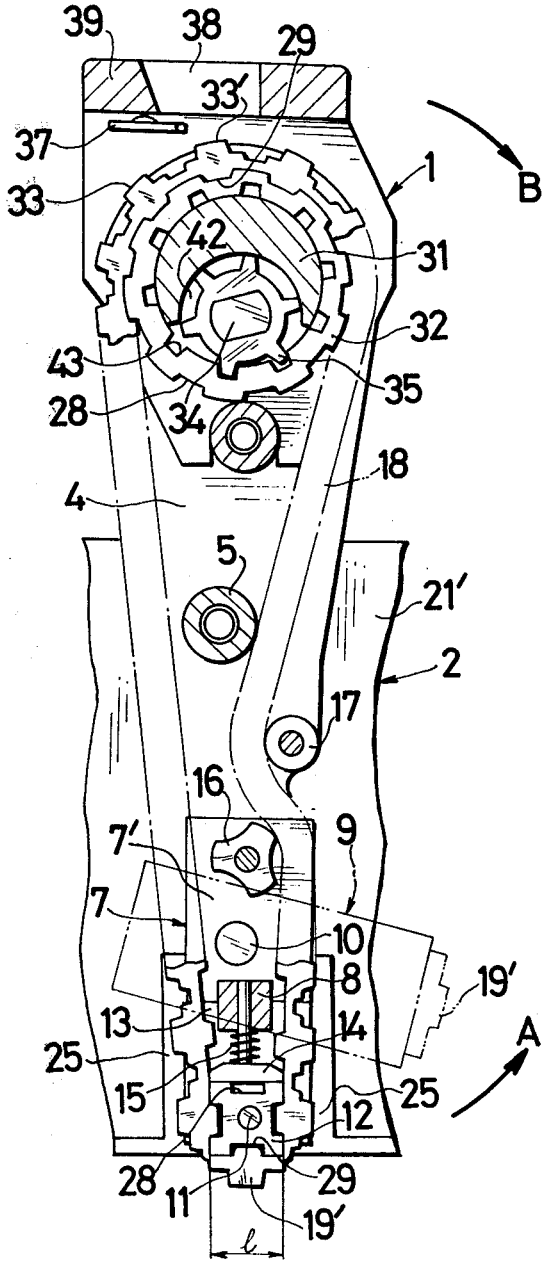
FIG. 3 is a cross-sectional view taken along the line of and in the direction of arrows III—III in FIG. 2.

The printing head shown in FIG. 1 includes three printing devices 1. As shown in FIGS. 2 and 3, each printing device 1 includes a pair of separated, opposed, elongated frames 4. The breadth of the frames 4 is gradually reduced from their upper ends of their lower ends. Frames 4 are connected together by a cylindrical connecting shaft 5 which extends between the frames and is located generally midway along the length of the frames. A female screw thread is formed on the inside surface of the shaft 5, and set screws 3 are passed through openings 24 in the housing and are tightened into engagement with this screw thread, which detachably mounts the printing devices on the housing.

A shaft 31 having a generally crescent shaped cross-section is fixedly attached to and extends between the upper sections of the frames 4 above shaft 5. A plurality of larger size, hollow center, rotation wheels 32, one for each below described stamp belt 18, are carried around and are individually rotatable on the shaft 31.

An H-shaped member 7 is provided. It is comprised of a pair of opposed, separated rectangular side plates 7' having approximately the same breadth as that of the lower ends of the frames 4 and is comprised of a shaft 8 of square cross-section which is integrally connected to the side plates 7' and holds them together. H-shaped member 7 has its upstanding side plates pivotally connected to the lower end portions of the frames 4 with bolts 10. In the lower portion of the H-shaped member 7, a shaft 11 is attached to the side plates 7'. A plurality of regular polygon shaped, particularly square shaped cross section rotation pieces 12, each respectively corresponding to one of the above-mentioned rotation wheels 32, are rotatably carried on shaft 11. Thin partitions 13 are located between adjacent rotation pieces 12.

Each of the rotation wheels 32 and rotation pieces 12 has identically shaped and sized recesses 28 disposed at regular intervals around its peripheral surface. Each stamp belt 18 has a plurality of projections 29 on its inner surface, which are engageable with the recesses 28 formed on the rotation wheel 32 and rotation piece 12 such that rotation of wheel 32 moves belt 18, which, in turn, rotates rotation piece 12. Each respective pair of a rotation wheel 32 and a rotation piece 12 are aligned along the length of printing device 1 and each such pair supports a respective stamp belt 18.

Each belt 18 is an endless belt of flexible material. It has a series of types 19 for printing indicia, which types are located on the exterior surface of the belt at the bottom of the printing device 1. It is desirable that the length of one side of rotation piece 12 be equal to the longitudinal length (indicated with l in FIG. 3) of the base portion of a type 19. Belt 18 also has a series of type indicating indicia 33, each of which corresponds in position and in its indicium to a respective type 19 on the exterior surface of the belt. The indicia are located at the top of the printing device. The series of types 19 on each belt 18 for printing indicia on labels are at the lower position on the stamp belt 18 and that portion of the belt that carries indicating indicia 33 is supported by each rotation wheel 32. The types 19 and indicia 33 are arranged in sequence and are so spaced that for each type 19', as it is in the print region at the bottom of the printing device 1, the corresponding indicium 33' is visible through the sight window 38 on the sight window frame 39.

A type selecting shaft 34 passes through the space 42 formed inside the rotation wheels 32 and inside the crescent surface of the shaft 31. A knob 36 is secured at the outer end (outside frame 4) of the type selecting shaft 34. The type selecting shaft 34 is movable along its own axis through the axial length of space 42. To so move shaft 34, knob 36 is pushed or pulled. Shaft 34 is supported by and moves througn a bearing in the fixedly located frame 4 and also passes through a bearing in the indicator bar 37. Fixed to the tip end of the shaft 34 is a star gear 35 whose teeth engage in the recesses 43 that are formed on the inside walls of the rotation wheels 32. Both the teeth of the gear 35 and the recesses 43 are spaced apart at the same regular intervals. By rotating the knob 36, one of the rotation wheels 32 is rotated by means of its being engaged by the star gear 35. This moves the respective stamp belt 18 which, in turn, causes rotation of the respective rotation pieces 12.

The flat upper surface of each rotation piece 12 is engaged by a respective T-shaped motion arrest and positioning member 14. Any other surface of rotation piece 12 may be engaged so long as it is not the print surface at the bottom, which supports the type 19' in the print position. The shafts of the T-shaped members 14 are received in respective holes formed at regular intervals along the square shaft 8 of the H-shaped member 7. Each member 14 is urged downward by spring 15 located between the cross bar of member 14 and shaft 8. This ensures that when printing is performed, the under surface of the rotation piece 12 and the type 19' then positioned on the undersurface are urged parallel to a platen (not shown) of a label printing machine.

The frames 4 carrying the larger-diameter rotation wheels 32 and the H-shaped member 7 carrying the rotation pieces 12 can be relatively pivoted about the above-mentioned H-shaped member supporting bolts 10 through up to 90 degrees in either of the directions indicated by arrows A and B in FIG. 3. In FIG. 3, a rotated H-shaped member 7 is shown with imaginary, broken lines. In order to prevent the stamp belts 18 from slacking during this pivoting movement of the H-shaped member 7, belt tensioning idler rollers 17 are attached to and extend between the frames 4. The position of belt tensioning rollers 17 may be determined in accordance with the pivotal attachment position of the H-shaped member 7 to the frames 4.

The three lobed rollers 16, one roller 16 for each belt 18, are attached to and are arrayed on a shaft extending across the space between the upper portion of plates 7' of H-shaped member 7, as shown in FIG. 3. Rollers 16 support the stamp belts 18 in cooperation with the above-mentioned tensioning rollers 17.

An indicator bar 37 points to a selected indicating indicium 33' in the sight window 38, which indicium 33' is on the stamp belt 18 that is on the rotation wheel 32 that is then being engaged by the star gear 35. The arm of bar 37 is of such length that its free end aligns with the position of gear 35. Because both gear 35 and bar 37 are held on shaft 34, they shift axially with shaft 34. Bar 37 is on a rotation bearing on shaft 34 so that the shaft may be rotated while the bar 37 remains at a constant rotation orientation.

Figure 4:
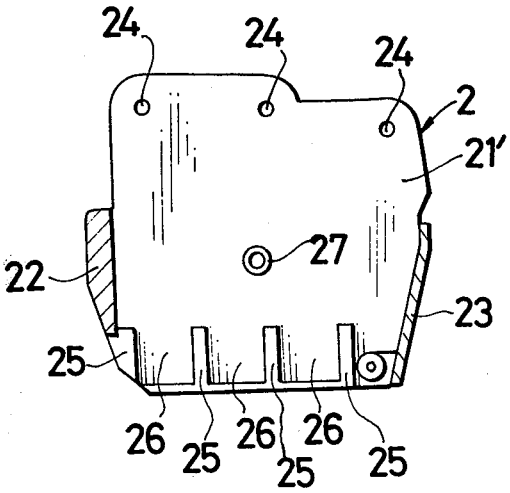
FIG. 4 is a cross-sectional view of the housing of the first embodiment for supporting printing devices.
Figures 5, 6:
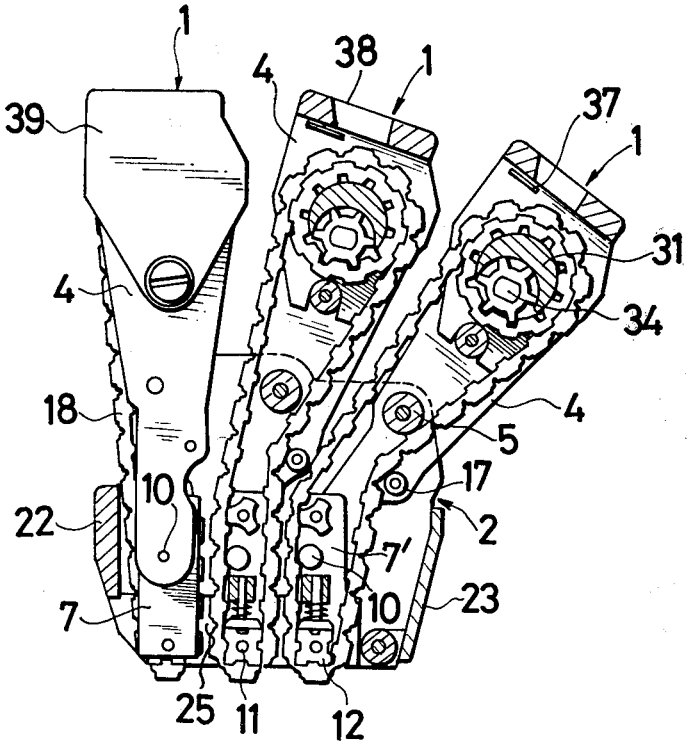
FIG. 5 is a cross-sectional side elevation of the printing head shown in FIG. 1.
FIG. 6 shows a label printed with three lines of indicia using the printing head of any embodiment of the present invention.

As shown in FIGS. 1, 4 and 5, the housing 2 in which the printing devices 1 are contained comprises a pair of opposed side walls 21 and 21', a front plate 22 and a rear plate 23 all connected together. In the upper portions of both of side walls 21 and 21' of the housing 2, aligned holes 24 are formed for receiving screws 3 that secure the printing devices 1 in the housing 2. Projecting inwardly from the lower inside surfaces of the side walls 21, 21' are a plurality of upstanding, vertical ridges 25 which are spaced apart from each other a distance corresponding to the breadth of the side plates 7' of H-shaped member 7, thereby forming grooves or pockets 26. The H-shaped members 7 of the printing devices 1 are fitted into the grooves 26. The width of each ridge 25 is selected such that each stamp belt 18 in the print region carried by the H-shaped member 7 does not come into contact with other stamp belts 18 on the adjacent printing devices 1.

When the printing devices 1 are mounted on the housing 2, the H-shaped member 7 of each printing device 1 is fitted into the opposed grooves 26 formed on the inside of the walls 21, 21' of the housing 2, and the frames 4 are attached to the side walls 21 and 21' of the housing 2 with set screws 3. In fitting printing devices 1 to a three-line printing head, for example, as shown in FIG. 5, the frames 4 of the printing device 1 for the first line (the printing device on the left side in FIG. 5) are oriented to extend vertically or straight out of the housing 2. When the printing devices 1 for the second and third lines are then attached, their frames 4 are pivoted about their bolts 10 relative to their H-shaped members 7 at respective tilt angles which ease insertion and operation of the printing devices.

In this printing head, since the types 19' on the arrayed printing device 1 can be brought as near to each other as possible so long as the stamp belts 18 in the print region do not come into contact, it is desirable that the breadth of a side plate 7' of an H-shaped member 7 totals the length of one side of the rotation piece 12, plus a two-fold thickness of the stamp belt 18.

Figure 7:
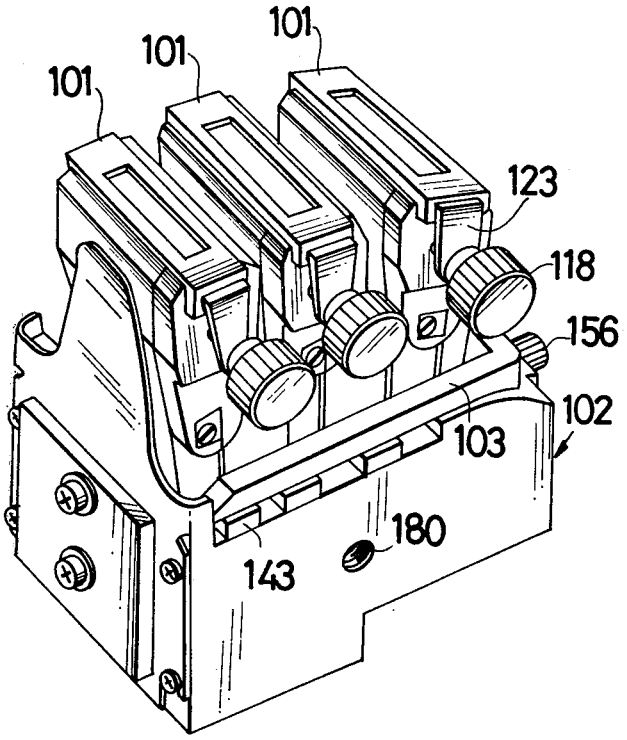
FIG. 7 is a perspective view of a second embodiment of the printing head of the present invention.

Another embodiment of the printing head of the present invention is now described. In FIG. 7, a three-line printing head according to this embodiment of the present invention is shown. The printing head comprises three printing devices 101, a boxlike housing 102 for encasing the printing devices 101 and a U-shaped fixing member 103 for firmly holding the printing devices 101 to the housing 102.

Figure 8:
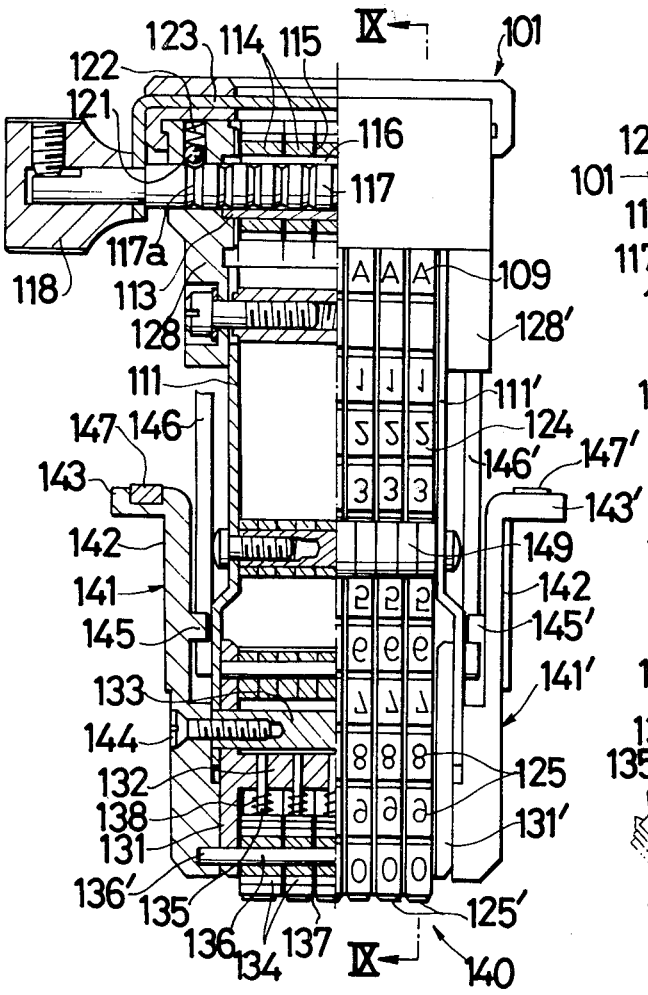
FIG. 8 is an elevational view, partially in cross-section, of a printing device that is fitted to the printing head shown in FIG. 7.
Figure 9:
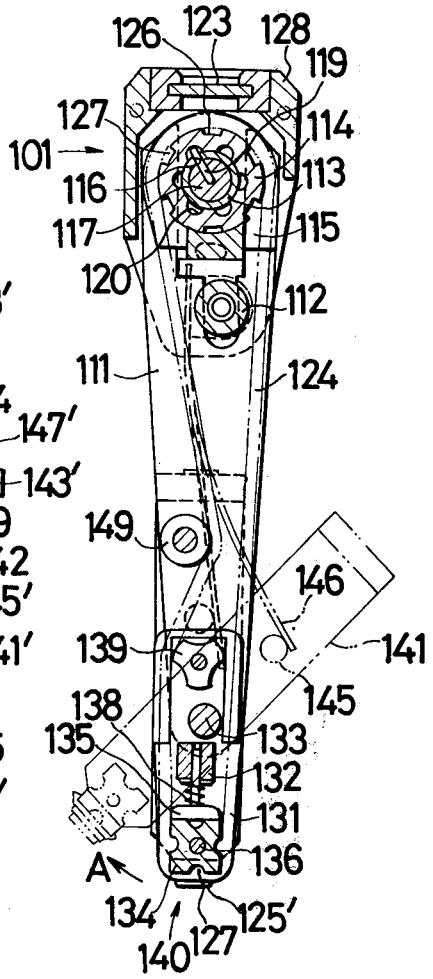
FIG. 9 is a cross-sectional view taken along the line of and in the direction of arrows IX—IX in FIG. 8.

As shown in FIGS. 8 and 9, a printing device 101 has a pair of opposed spaced apart frame plates 111 and 111', which are fixedly connected together by a stay shaft 112. A hollow tubular shaft 113 is supported by and between the upper portions of the frame plates 111 and 111' and shaft 113 is held in rotation bearings (not shown) in plates 111, 111'. A plurality of rotation wheels 114 are carried and are arrayed side-by-side on the tubular shaft 113. Thin partitions 115 are interposed between adjoining wheels 114. Each rotation wheel 114 can be separately rotated.

An elongated slot 116 is formed in and extends axially along a portion of the wall of the tubular shaft 113. Within the hollow center of shaft 113 is inserted a selector shaft 117 which is slidable in the axial direction. To the outer projecting end of selector shaft 117, a knob 118 is attached for rotating the shaft 117. The other inner end of the shaft 117 is provided with a radially extending pin 119 which is passed through the slot 116 and projects into engagement with one of the recesses 120 that are formed at regular intervals around the inside walls of all of the rotation wheels 114. All recesses 120 in rotation wheels 114 are normally aligned, for reasons discussed below. By the axial movement of the selector shaft 117 through manipulation of the knob 118, the pin 119 is moved axially of the shaft 113 through the slot 116 and through the aligned recesses 120 of the array of rotation of wheels 114. Because the pin 119 is in engagement with only one recess 120 of one rotation wheel 114 at a time, when the knob 118 is rotated, only the selected rotation wheel 114, in which pin 119 is located, is rotated.

A plurality of annular grooves **117*a* are formed along the selector shaft 117 at regular intervals. A steel ball 121 is urged by a spring 122 into engagement with one of the grooves 117*a*. Thus, axial shifting of the selector shaft 117 can be stopped at predetermined positions corresponding to pin 119 being inside a prticular wheel 114. The L-shaped member 123 attached to the shaft 117 is of a length to cause member 123 to indicate the rotation wheel 114 which is then in engagement with the pin 119**.

The breadth of the above-mentioned frame plates 111 and 111' is reduced from the upper ends to the lower ends of the plates. At the narrow lower ends of the frame plates 111 and 111', a pair of side plates 131 and 131' are pivotally supported on a shaft 133. The side plates 131 and 131' are connected together by a square cross-section shaft 132 whereby the side plates and shaft 132 form an H-shaped member. The lower end positions of the side plates 131 and 131' support a transverse shaft 136 which extends through and beyond the side plates 131 and 131'. Shaft 136 rotatably carries a plurality of regular polygon shaped, preferably square rotation pieces 134, which are separated from the neighboring rotation pieces by interposed thin partitions 137. Each rotation piece 134 corresponds to a respective above-mentioned rotation wheel 114. The upper sides of the rotation pieces 34 are engaged by respective spring 138 biased rotation piece orientation angle controlling members 135, having T-shaped cross-sections (analogous to members 14, 15).

Each rotation wheel 114 and its corresponding rotation piece 134 support an endless stamp belt 124 that passes around them. The outside of the lower portion of the stamp belt 124 is provided with a series of types 125 spaced at regular intervals. The outside of the upper portion of the belt is provided with a series of indicating indicia 109 each of which corresponds to an above-mentioned type 125. The inner surface of each stamp belt 124 is provided with a plurality of projections 126 (FIG. 9) which enter engaging grooves 127 formed on the peripheral surfaces of the respective rotation wheel 114 and rotation piece 134. Accordingly, when the selector shaft 117 is rotated by the knob 118, the stamp belt 124 whose rotation wheel is then being engaged by pin 119 can be rotated reliably and correctly.

Since the above-mentioned angle controlling members 135 are urged downward by springs 138, the under surfaces of rotation pieces 134 will always set in an orientation parallel to a platen (not shown). Accordingly, all types 125' then positioned beneath the under surfaces of the rotation pieces 134 are also kept parallel to the platen. Each of the rotation pieces 134 is square (like the rotation pieces 12) and is held with one side parallel to a platen. Thus, all rotation pieces 134 are aligned at the same orientation. Because the positions of all rotation wheels 114 corresponds to the aligned positions of their rotation pieces as a result of all rotation wheels and pieces being joined by their stamp belts 124, all recesses 120 are aligned, thus enabling pin 119 to be moved axially.

There is a printing portion 140 comprised of the side plates 131 and 131' which are pivotally mounted to the frame plates 111 and 111' by shaft 133, the lobed stamp belt supporting rollers 139 (analogous to rollers 16) which are pivoted to the upper ends of the side plates 131 and 131', and the rotation pieces 134 which are being pushed down by the angle controlling members 135. Thus the printing portion 140 carrying the stamp belts 124 can be pivoted clockwise (in FIG. 3) up to about 90 degrees around the pivot shaft 133.

Figure 13:
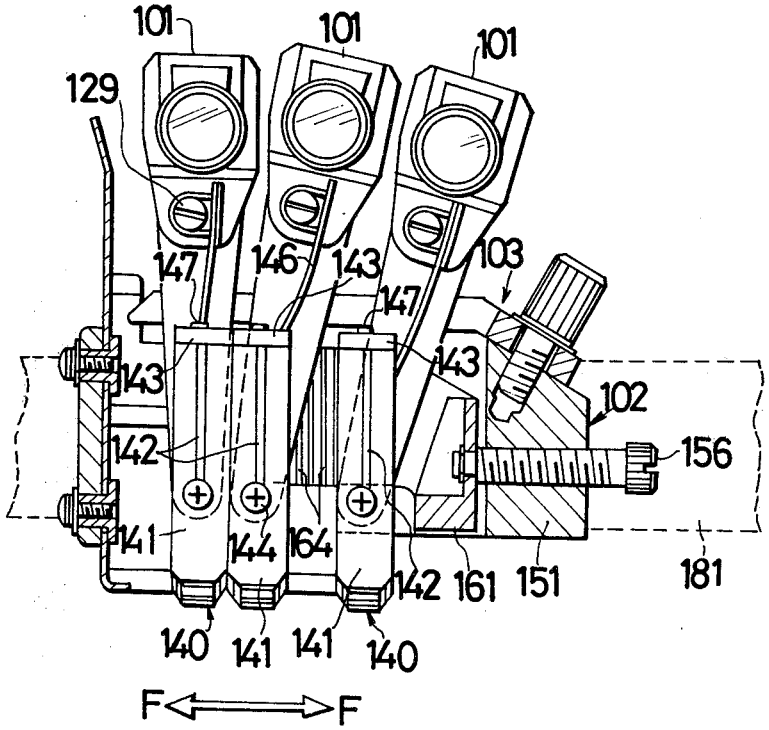
FIG. 13 is a cross-sectional view showing the internal structure of the printing head shown in FIG. 7.

Each of a pair of fitting plates 141 and 141' having the same breadth as the side plates 131 and 131' is attached to the outside of a respective side plate 131 and 131'. The middle portions of the fitting plates 141 and 141' are fixed to the side plates 131 and 131' with screws 144 (FIGS. 8 and 13). The lower ends of the fitting plates 141 and 141' are attached on the projecting ends 136' of the shaft 136 for the rotation pieces 134. Thus, the fitting plates 141 and 141' can be pivoted around the shaft 133 in the direction of the arrow A, together with the printing portion 140.

As shown in FIGS. 8 and 13, thin width ridges 142 and 142' are formed on and extend longitudinally along the outsides of the fitting plates 141 and 141'. These ridges 142 and 142' are slidably fitted into the below described complementary engaging grooves 164 formed on the insides of the walls of the movable frame 161 of the housing 102. The grooves and ridges are complementary. Therefore, their positions could be reversed with the grooves being on the fitting plates 141, 141' and the ridges being on the housing frame. Also, only a single ridge 142 or 142' is shown. But, there could be any number of ridges. However, the ridge spacing on any fitting plate would have to match the groove spacing on the housing wall. Similarly, with an appropriate number of ridges being provided, there could be fewer complementary grooves, and as few as one may be needed.

The upper end portions of the fitting plates 141 and 141' are bent outwardly at right angles so as to form ears 143 and 143' which are to be seated on and carried by shoulders at the top of the housing 102. The upper surfaces of the ears 143 and 143' are provided with inlaid shock-absorbers 147 and 147'. The upper surfaces of the shock-absorbers 147 and 147' are raised slightly above the upper surfaces of the ears 143 and 143'. On the inside surfaces of the middle portions of the fitting plates 141 and 141' are formed projections 145 and 145' which are in constant engagement with first end portions of the return springs 146 and 146'. The return springs 146 and 146' are fixed to the frame plates 111 and 111' by set screw 129 together with the outer frames 128 and 128' (see FIGS. 8, 9 and 13). The return springs 146 and 146' are plate springs and they maintain the printing portion 140 in line with the frame plates 111 and 111' (solid line position of FIG. 3).

The printing device is further provided with tension rollers 149 carried on frame plate 111, 111' which prevent the stamp belts 124 from slackening when the printing portion 140 is pivoted.

Figure 10:
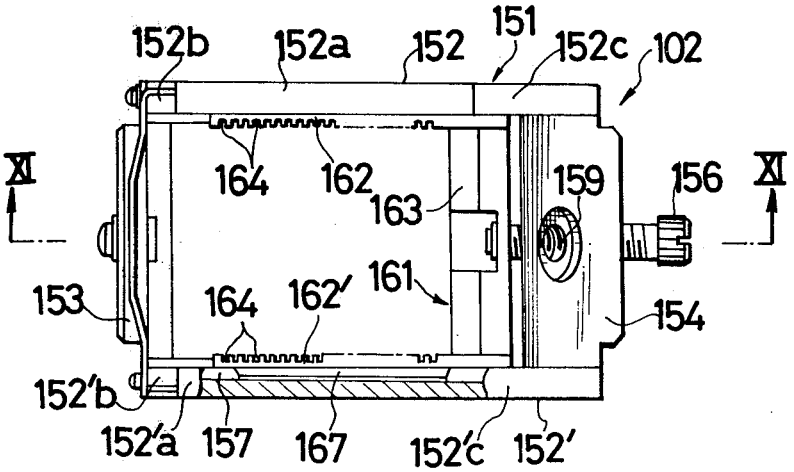
FIG. 10 is a plan view of the housing of the second embodiment of the printing head.
Figure 11:
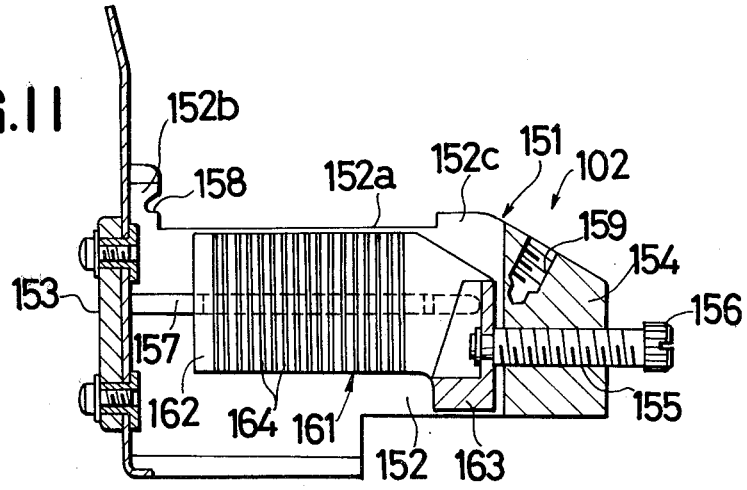
FIG. 11 is a cross-sectional view of the housing taken along the line of and in the direction of arrows XI—XI in FIG. 10.

As shown in FIGS. 10 and 11, the housing 102 for supporting the above-described printing devices 101 comprises a fixed frame 151 and a movable frame 161 which is movable inside the fixed frame 151 in the forward and backward (left and right in FIG. 4). The combined movable and fixed frame arrangement is expressly described for the present second embodiment. However, the housing for the first embodiment could also be comprised of two frames, with the grooves 26 being formed on the interior walls of the movable frame. The fixed frame is comprised of a pair of opposed outside plates 152 and 152', a front plate 153 and a rear plate 154, which are fixedly joined together. The movable frame 161 is comprised of a pair of opposed inside plates 162 and 162' and a connecting plate 163 which are fixedly joined in a U-shaped configuration.

In the middle portion of the rear plate 154 of the fixed frame 151, there is a threaded screw hole 155 (FIG. 11), into which an adjusting screw 156 is threaded. The tip of the screw 156 is attached to the rear connecting plate 163 of the movable frame 161. On the inner walls of the outside plates 152 and 152' of the fixed frame 151, horizontally extending grooves 157 are formed. Correspondingly shaped ribs 167 are formed on the outer walls of the inside plates 162 and 162' of the movable frame 161 (FIG. 10). The ribs 167 are received within the grooves 157. Thus, the movable frame 161 can be slid along the grooves 157 on the inside walls of the fixed frame 151 by operating the adjusting screw 156.

On the inner walls of the inside plates 162 and 162' of the movable frame 161, a plurality of closely spaced, vertically oriented, inwardly projecting, engaging grooves 164 are formed at regular intervals. (Of course, if the fitting plates 141, 141' carry grooves, then the frame 161 will have the ridges.) In a preferred embodiment, the engaging grooves 164 for receiving the ridges 142 and 142' of the fitting plates 141 and 141' are formed at every 1.5 mm and the width of each groove 164 is 1.0 mm. Each engaging groove 164 is engageable with the ridges 142 and 142' of the fitting plates 141 and 141'. In this manner, the printing portions 140 of printing devices 101 are supported vertically.

The outside plates 152 and 152' of the fixed frame 151 have upper surfaces 152a and 152a', respectively, with shoulders that support the ears 143 and 143' of fitting plates 141 and 141' of the printing device 101. At the front ends of the upper surfaces 152a and 152a' of the outside plates 152 and 152', projections 152b and 152b' are formed. Each such projection is provided with an internal recess 158 on its rearwardly facing wall. At the rear ends of the upper surface 152a and 152a', raised portions 152c and 152c' are formed. The rear parts of the raised portions 152c and 152c' are sloped gradually down. The difference in height between the upper surfaces 152a and 152a' and the raised portions 152c and 152c' is made a little larger than the thicknesses of ears 143 and 143' of the fitting plates 141 and 141', while it is made slightly smaller than the distance between the lower surfaces of ears 143 and 143' and the upper surfaces of the shock-absorbers 147 and 147'. Further, the height of the lower edge of the recess 158 is at the same height as the raised portions 152c and 152c'.

Figure 12:
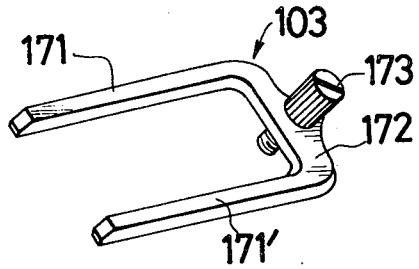
FIG. 12 is a perspective view of a fixing member used with the second embodiment of the printing head.

The fixing member 103 for securing the printing devices 101 to the housing 102 is U-shaped, as shown in FIG. 12. The tips of both arms 171 and 171' of the fixing member 103 are the same form as the cross-section of the recess 158 so as to be securely received in the recesses 158. The rearwardly located connecting portion 172 of the fixing member 103 is bent down so as to be fitted to and seat upon the inclined surfaces of the raised portions 152c and 152c'. At the middle portion of the connecting portion 172 is attached a fixing screw 173 which engages in the screw hole 159 that is formed in the middle portion of the rear plate 154 of the fixed frame 151.

The printing devices 101 of the present invention can be assembled into a multi-line printing head as shown in FIG. 13. The ridges 142 and 142' of the fitting plates 141 and 141' which ridges are integrally formed with the printing portion 140, are brought into engagement with the engaging grooves 164 of the movable frame 161. The ears 143 and 143' of the fitting plates 141 and 141' are rigidly clamped against the shoulders on surfaces 152a and 152a' by the fixing member 103 which presses against the ears by pressing on the shock-absorbers 147 and 147' on the ears.

The three printing devices 101 disposed in the movable frame 161 are moved in the fixed frame 151 in the forward and rearward directions (indicated with an arrow F—F in FIG. 13) by rotation of the adjusting screw 156. Printing devices 101 shift against the frictional resistance caused by the engagement between the shock-absorbers 147 and 147' and the fixing member 103.

The effects and advantages of the second embodiment of the present invention are now summarized:

(1) The printing portion 140 of the printing device 101 can be pivoted relative to the frame plates 111 and 111' on the pivot shaft 133, while the ridges on the fitting plates 141 and 141' are mated with the closely spaced engaging grooves 164 on the movable frame 161. Therefore, the printing portions 140 of the printing devices 101 can be disposed quite close together in the housing 102 and the spaces between the printing devices 101 can be varied accurately, for example, to the extent of every 0.5 mm. Thus, a quite extensive variety of dispositions of printing devices is available.

(2) The printing devices 101 arranged in the movable frame 161 of the housing 102 can be moved in the forward and rearward directions by operating the adjusting screw 156. Therefore, the portion of the printing on each of the labels can be accurately adjusted.

(3) A plurality of printing devices 101 can be fitted to the housing 102 by easy manual operation of the U-shaped fixing member 103 without using any special tool. Therefore, changing or rearranging of the printing devices 101 can be performed easily and quickly, and the workability of the printing head is much improved.

The assembled multi-line printing head of either embodiment is mounted in the same way. The second embodiment is illustrative. The printing head is mounted on the tip ends of rocking levers 181 of a label printing machine (not shown), or the like, by a screw (not shown) passed through hole 180. When the rocking levers 181 are moved vertically, the printing head is also moved vertically. At the lowermost position of the printing head, an individual label on a longer label strip (not shown), which label is passed under the printing head, is printed by the types 125' and produces the result shown in FIG. 6.

Although a printing head having three printing devices 1 or 101 has been described, two-line, four-line or any other number of lines of print and printing devices may easily be assembled in a printing head according to any embodiment of the invention.

Although the present invention has been described in connection with preferred embodiments thereof, many further variations and modifications will now become apparent to those skilled in the art. It is preferred, therefore, that the present invention be limited not by the specific disclosure herein, but only by the appended claims.

I claim:

1. A printing head for a label printing machine comprising:

a plurality of printing devices and a housing in which said printing devices are supported;

each said printing device comprising:

a pair of spaced apart, opposed, elongated frames; each said frame having a top, an upper portion near said top, a bottom and a lower portion near said bottom;

at least one rotation wheel pivotally attached at and located between said frame upper portions;

an H-shaped member having elongated side plates which are each pivotally secured intermediate their lengths to a respective said frame near said lower portion thereof; a lateral bar joining said side plates;

a respective rotation piece for each said rotation wheel; said rotation piece being pivotally attached to and being located between said side plates below said pivotal connection of said side plates to said frame;

a stamp belt for and passing around and engaging each set comprised of a said rotation wheel and a said rotation piece; first mutual engagement means on said belt and on said rotation wheel and said rotation piece, whereby said belt is rotatable with said rotation wheel and said rotation piece; printing types on said belt; a print direction at said bottom of said frame toward which each said type faces when it is in position for printing;

said housing comprising:

two opposed, spaced apart side walls with interior facing surfaces; a plurality of neighboring second engagement means each having the same dimension of elongation toward said print direction and being arrayed in a line transverse to said print direction on and along said side wall interior surfaces for engaging said side plates;

third engagement means connected with said side plates and engageable with said second engagement means;

said second and said third engagement means being so shaped and positioned that a plurality of said side plates and their respective said printing devices may be placed side-by-side in said housing in a line transverse to said print direction and said printing devices are emplaceable in and removable from said housing by motion generally along their said dimension of elongation and generally in said print direction.

2. The printing head of claim 1, wherein said rotation wheel is larger in diameter than the width of said side plates and than the width of said rotation piece.

3. The printing head of claim 2, wherein said second and said third engagement means are so shaped and positioned that neighboring said printing devices are emplaceable in said housing at spacing distances smaller than the diameters of said rotation wheels would permit if said rotation wheels were emplaced in said second engagement means in said housing.

4. The printing head of claim 1, wherein said second engagement means comprise a plurality of ridges oriented to extend generally in said print direction and being formed in and projecting from said side wall interior surfaces; neighboring said ridges being spaced apart a distance to enable a said side plate to be received and held therebetween.

5. The printing head of claim 4, wherein the spacing between neighboring ones of said second engagement means grooves is at least as small as the width of a said side plate connectable therewith.

6. The printing head of claim 4, further comprising a fitting device; said fitting device being engageable with said housing for supporting said fitting device at a fixed location on said housing; said fitting device also being engageable with said printing devices for pressing and holding emplaced ones of said printing devices in said housing.

7. The printing head of claim 6, further comprising a respective fitting plate located on the outside of and attached to and serving as part of each said side plate; each said fitting plate including an ear which is engageable with said housing upon the respective said printing device being moved into said housing a predetermined distance; said ear holding its said printing device at the location at which that said ear and said housing engage; said fitting device engaging said printing device by engaging said ears thereof.

8. The printing head of claim 1, wherein said second engagement means comprise a plurality of neighboring, closely spaced, generally parallel grooves oriented to extend generally in said print direction and being formed in said side wall interior surfaces and said third engagement means comprise at least one ridge matably shaped to a said groove.

9. The printing head of claim 8, wherein the spacing between neighboring ones of said second engagement means grooves is at least as small as the width of a said side plate connectable therewith.

10. The printing head of claim 8, further comprising a fitting device; said fitting device being engageable with said housing for supporting said fitting device at a fixed location on said housing; said fitting device also being engageable with said printing devices for pressing and holding emplaced ones of said printing devices in said housing.

11. The printing head of claim 10, further comprising a respective fitting plate located on the outside of and attached to and serving as part of each said side plate; each said fitting plate including an ear which is engageable with said housing upon the respective said printing device being moved into said housing a predetermined distance; said ear holding its said printing device at the location at which that said ear and said housing engage; said fitting device engaging said printing device by engaging said ears thereof.

12. The printing head of claim 1, wherein there are a plurality of said belts and a corresponding plurality of respective said rotation wheels and respective said rotation pieces;

stamp belt selector means connectable with selected different ones of said rotation wheels for engaging the said rotation wheels with which that said selector means is in engagement and thereby rotating its respective said stamp belt.

13. The printing head of claim 12, wherein each said rotation wheel has an opening passing through its center; said selector means comprising a shaft passing through said rotation wheel openings and comprising a rotation wheel engaging element on said selector means shaft for engaging each said rotation wheel; said selector means shaft being movable axially through said rotation wheel openings and being rotatable to rotate each said rotation wheel with which said rotation wheel engagement element is then in engagement.

14. The printing head of claim 13, further comprising an indicator bar supported by said selector means shaft and located outside said frame and being carried on said selector means shaft so as to be axially movable therewith, whereby the position of said indicator bar indicates with which said rotation wheel said selector means rotation wheel engagement element is then in engagement.

15. The printing head of claim 14, further comprising indicia on said stamp belt and spaced around said stamp belt from said types and each said indicium corresponding in appearance and position to a respective said type;

a view window on said frame and positioned for viewing indicia on said stamp belt; said indicia and said types being so arranged on said stamp belt that the said indicium visible at said window corresponds to the said type at said position for printing and which is aimed in said print direction.

16. The printing head of claim 1, wherein said rotation piece is a regular polygon;

a rotation piece rotation arrest member in engagement with a side of said rotation piece, which said side of said rotation piece is facing away from said print direction; biasing means biasing said arrest member against said rotation piece, which thereby causes said rotation piece to assume a position at which the said side thereof that is directed in said print direction remains constantly oriented and facing toward said print direction.

17. The printing head of claim 16, wherein each said type has a length along said belt; said rotation piece being square in shape; said square having sides of a length approximating said length of a said type.

18. The printing head of claim 1, wherein said rotation piece is a regular polygon;

said side plate having a width approximating the sum of the cross-sectional width of said rotation piece plus twice the thickness of said stamp belt.

19. The printing head of claim 1, wherein said housing is comprised of a relatively fixed frame and a relatively movable frame; said housing opposed side walls being part of said movable frame;

frame adjustment means joining said fixed and said movable frames and for adjusting the relative positions of said frames along a direction generally parallel to the surfaces on which said types print, which is transverse to said print direction.

20. The printing head of claim 1, further comprising a fitting device engageable with said housing for supporting said fitting device at a fixed location on said housing; said fitting device also being engageable with said printing devices to press and hold emplaced ones of said printing devices in said housing.

21. The printing head of claim 20, further comprising a respective fitting plate located on the outside of and attached to and serving as part of each said side plate; each said fitting plate including an ear which is engageable with said housing upon the respective said printing device being moved into said housing a predetermined distance; said ear holding its said printing device at the location at which that said ear and said housing engage; said fitting device engaging said printing device by engaging said ears thereof.

22. The printing head of claim 1, comprising means for rotating said upper portion of each of said elongated frames with respect to the respective said H-shaped member to facilitate adjustment and positioning of the belts on each of said frames.

23. The printing head of claim 22, further comprising tensioning means provided for each of said belts; said tensioning means remaining in engagement with said belts when said frames are rotated with respect to each other and said housing.

24. A printing head for a label printing machine, comprising:

(1) first and second printing devices, each said printing device comprising:

(a) a first frame having an upper portion and a lower portion spaced from said upper portion;

(b) first stamp belt rotating means attached to said upper portion of said first frame;

(c) a second frame pivotally connected to said first frame at said lower portion of said first frame;

(d) second stamp belt rotating means attached to said second frame at a point spaced from the point at which said first frame is pivotally connected to said second frame;

(e) a stamp belt passing around and engaging said first and second stamp belt rotating means;

(2) a housing supporting said second frames of said first and second printing devices at a predetermined orientation with respect to each other and permitting said first frame of each of said first and second printing devices to be independently pivoted relative to said housing with respect to said first frame of the other of said first and second printing devices.

25. The printing head of claim 24, further comprising: belt tensioning means for preventing said stamp belt from slackening when said first frame is pivoted about said second frame.

* * * * *